US008220475B2

(12) United States Patent
Yul et al.

(10) Patent No.: US 8,220,475 B2
(45) Date of Patent: Jul. 17, 2012

(54) PORTABLE STRUCTURE CONFIGURED TO DRAIN RAINWATER

(75) Inventors: Lee Pil Yul, Fujian (CN); Yang Wei Dong, Fujian (CN)

(73) Assignee: North Pole Limited, Kowloon (HK)

( * ) Notice: Subject to any disclaimer, the term of this patent is extended or adjusted under 35 U.S.C. 154(b) by 223 days.

(21) Appl. No.: 12/407,599

(22) Filed: Mar. 19, 2009

(65) Prior Publication Data

US 2010/0065095 A1 Mar. 18, 2010

(30) Foreign Application Priority Data

Mar. 19, 2008 (CN) ..... 2008 2 0101733 U

(51) Int. Cl.
*E04H 15/02* (2006.01)
*E04H 15/54* (2006.01)
*E04D 13/00* (2006.01)

(52) U.S. Cl. ..... 135/96; 135/115; 52/12

(58) Field of Classification Search ..... 135/96, 135/156–158, 160, 115; 52/12
See application file for complete search history.

(56) References Cited

U.S. PATENT DOCUMENTS 3,327,724 A * 6/1967 Nielsen ..... 135/121
4,271,856 A 6/1981 Ferguson
4,308,883 A 1/1982 Malone
4,450,656 A 5/1984 Lagendijk
5,035,253 A 7/1991 Bortles
5,107,881 A * 4/1992 Feldman et al. ..... 135/124
5,234,011 A * 8/1993 Lynch ..... 135/99
5,638,850 A 6/1997 Hazinski et al.
6,216,715 B1 4/2001 Howe
6,345,638 B1 2/2002 Warner
7,108,005 B1 9/2006 Christenson et al.
7,216,657 B2 5/2007 Choi
2005/0178417 A1 8/2005 Holub
2007/0062567 A1 3/2007 Warner

FOREIGN PATENT DOCUMENTS

JP 11293963 A * 10/1999

* cited by examiner

*Primary Examiner* — David Dunn
*Assistant Examiner* — Danielle Jackson
(74) *Attorney, Agent, or Firm* — Armstrong Teasdale LLP

(57) ABSTRACT

A portable structure defining an interior volume, and configured to facilitate draining rainwater. The portable structure includes a frame including a central support and a side support shorter than the central support. A roof fabric has a first edge coupled to the central support and an opposing second edge coupled to the side support. At least a portion of the roof fabric extends downward at the second edge with respect to a ground plane to define a concavity. An apron fabric is coupled to the roof fabric at a joint. The apron fabric is configured to extend toward the ground plane. A portion of the apron fabric defines a concave cavity that extends inward with respect to the volume of the portable structure. The concave cavity is in flow communication with the concavity to define a passage configured to drain rainwater from the roof fabric.

17 Claims, 2 Drawing Sheets

A-A

PORTABLE STRUCTURE CONFIGURED TO DRAIN RAINWATER

CROSS REFERENCE TO RELATED APPLICATIONS

This application claims the benefit of Chinese Patent Application 200820101733.4 filed on Mar. 19, 2008, which is hereby incorporated by reference in its entirety.

BACKGROUND OF THE INVENTION

The field of the invention relates generally to a portable structure, such as a tent, and, more particularly, to a tent having a component or structure that facilitates draining of water, such as rainwater, from the tent fabric to prevent or limit undesirable accumulation of such water on areas of the tent fabric.

In recent years, tent camping has become increasingly more popular with rapid economic development and enhancement of living standards throughout the world. Conventional tents include a tent frame, a tent fabric connected with the frame and an apron fabric connected about a lower circumference of the tent fabric such that the apron fabric encircles an outer perimeter defined by the frame. Conventional tents may not include a draining component or structure for rapidly draining rainwater collected on the tent fabric during a rain storm and, as a result, a large amount of rainwater may accumulate on the tent fabric that will impose a heavy burden on the tent fabric and/or the tent frame, such that a service life of the tent may be reduced.

BRIEF DESCRIPTION OF THE INVENTION

In one aspect, a tent defining an interior volume and configured to facilitate draining rainwater is provided. The tent includes a frame, a tent fabric connected with the frame, and an apron fabric connected with the tent fabric. A portion of the apron fabric defines a concave cavity that extends inward with respect to the interior volume of the tent. A portion of the tent fabric is connected with the portion of the apron fabric defining the concave cavity. The portion of the tent fabric extends downward with respect to a ground plane to define a concavity in flow communication with the concave cavity to define a passage configured to drain rainwater from the tent fabric.

In another aspect, a portable structure defining an interior volume, and configured to facilitate draining rainwater, is provided. The portable structure includes a frame including a central support and a side support shorter than the central support. A roof fabric has a first edge coupled to the central support and an opposing second edge coupled to the side support. At least a portion of the roof fabric extends downward at the second edge with respect to a ground plane to define a concavity. An apron fabric is coupled to the roof fabric at a joint. The apron fabric is configured to extend toward the ground plane. A portion of the apron fabric defines a concave cavity that extends inward with respect to the interior volume of the portable structure. The concave cavity is in flow communication with the concavity to define a passage configured to drain rainwater from the roof fabric.

In a further aspect, a method is provided for making a tent configured to facilitate draining rainwater. The method includes forming a tent fabric having a first edge that is configured to couple to a first support and an opposing second edge configured to couple to a second support shorter than the first support such that, with the tent constructed to define an interior volume, at least a portion of the tent fabric extends downward at the second edge with respect to a ground plane to define a concavity. An apron fabric is coupled to the tent fabric at a joint. With the tent constructed, the apron fabric is configured to extend toward the ground plane, and a portion of the apron fabric defines a concave cavity that extends inward with respect to an interior volume of the constructed tent. The concave cavity is in flow communication with the concavity to define a passage configured to drain rainwater from the tent fabric.

DETAILED DESCRIPTION OF THE INVENTION

This disclosure describes a portable structure, such as a tent, configured to facilitate preventing or limiting accumulation of rainwater on a roof or tent fabric. In one embodiment, the tent includes a draining component or structure to facilitate draining rainwater from the tent fabric to prevent or limit accumulation of rainwater on the tent fabric. The tent includes a tent frame, a tent fabric connected with the tent frame, and an apron fabric connected with the tent fabric at a lower circumference of the tent fabric. A portion of the apron fabric, such as a top edge portion of the apron fabric defines a concave cavity that extends inward with respect to a volume defined by the tent. A portion of the tent fabric, such as a bottom edge portion of the tent fabric at least partially coupled to the top edge portion of the apron fabric, extends downward to define a concavity. The concave cavity cooperates with or is in flow communication with the concavity to define a passage for the rainwater to move through to prevent or limit accumulation of rainwater on the tent fabric. In one embodiment, the passage is positioned within a central area of the tent fabric and the apron fabric and does not extend an entire width of the tent fabric and the apron fabric. In alternative embodiments, an alternative passage or an additional passage may be formed at one or more ends or corners of the tent fabric.

Figure 1:
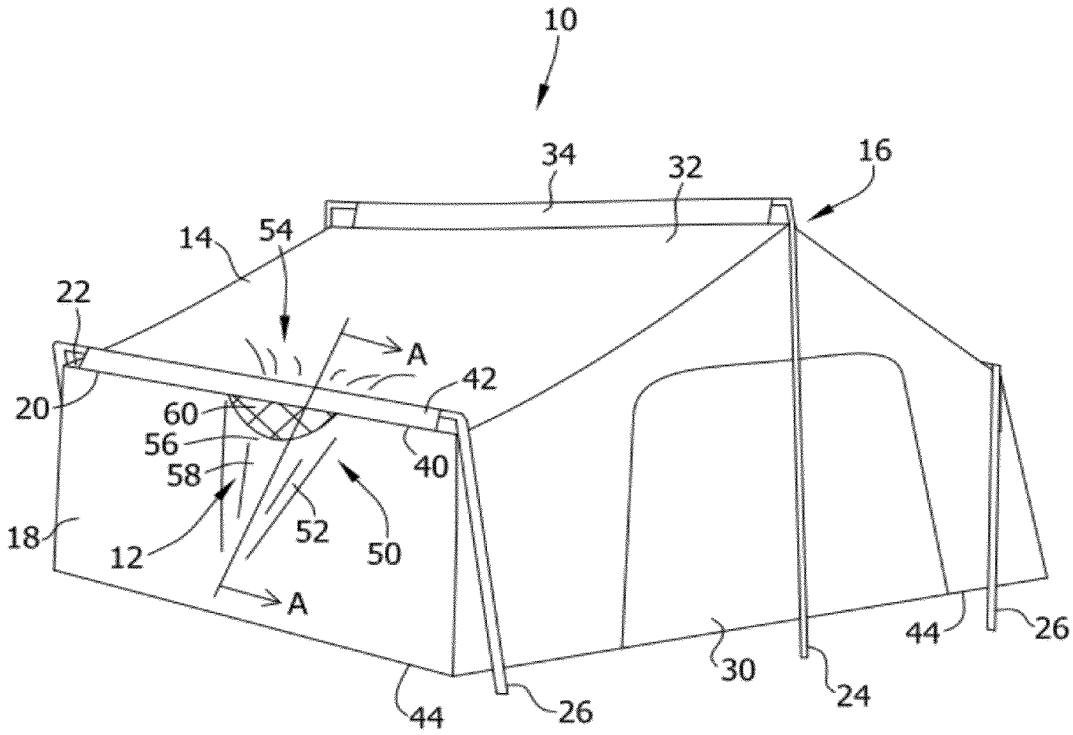
FIG. 1 is a perspective view of an exemplary tent.
Figure 2:
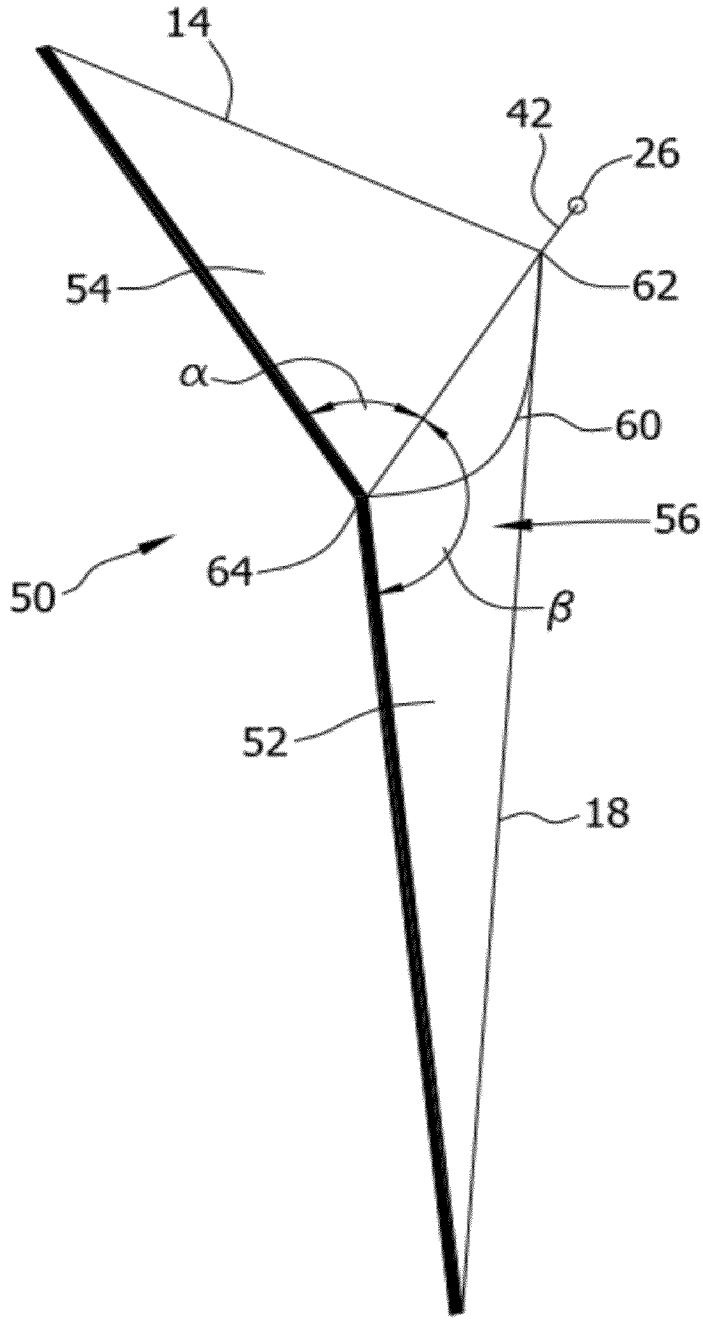
FIG. 2 is a sectional view through sectional line A-A of a portion of the tent including a draining structure, as shown in FIG. 1.

Referring to FIGS. 1 and 2, a portable structure, such as a tent 10, includes a drainage mechanism 12 that prevents or limits the undesirable accumulation of rainwater on a tent fabric 14, such as a roof panel or a roof fabric. Tent 10 includes a tent frame 16, tent fabric 14 connected with or coupled to tent frame 16, and an apron fabric 18 having a first or top edge portion 20 that is at least partially connected with or at least partially coupled to a first or lower edge portion 22 of tent fabric 14 and, in one embodiment, at least partially located outside tent frame 16.

Tent frame 16 includes three U-shaped supports that are arranged in a left-to-right direction generally in parallel. The U-shaped support in the middle acts as a central support 24, and the two U-shaped supports on the opposing left side and right side act as a side support 26. Each side support 26 is located on a respective side of central support 24, as shown in FIG. 1. Referring further to FIG. 1, central support 24 extends in a vertical direction with respect to a ground plane to a distance greater than a distance to which side supports 26 extend in the vertical direction, i.e., side supports 26 are shorter than central support 24.

Apron fabric 18 is equipped with a door 30 for users of tent 10 to access the interior volume defined by tent 10. A top or central region 32 of tent fabric 14 is coupled to central support 24 by a connecting fabric 34 and is configured to hang therefrom. Top edge portion 20 of apron fabric 18 extends about at least a portion of a circumference or a perimeter of apron fabric 18 and is connected with or coupled to bottom edge portion 22 of tent fabric 14 that extends about at least a portion of a circumference or perimeter of tent fabric 14 at a joint 40. Joint 40 may include any suitable coupling mechanism or fastener, such as a zipper or a sewing seam. In the exemplary embodiment, tent fabric 14 and/or apron fabric 18 is coupled at joint 40 to respective side support 26 by a connecting fabric 42. A lower edge portion 44 of apron fabric 18 defines a lower circumference or a lower perimeter of apron fabric 18 and is located at or near the ground plane. In one embodiment, apron fabric 18 is removably coupled to the ground plane with one or more tent stakes or any suitable coupler.

Referring further to FIGS. 1 and 2, tent 10 includes a draining structure 50 to facilitate draining rainwater from tent fabric 14 to prevent or limit accumulation of rainwater on tent fabric. Top edge portion 20 of apron fabric 18 defines a concave cavity 52 that sags or extends inward with respect to the interior volume of tent 10. Further, bottom edge portion 22 of tent fabric 14 is connected with or coupled to top edge portion 20 of apron fabric 18 defining concave cavity 52 and sags or extends downward with respect to the ground plane to define a concavity 54. Concavity 54 cooperates with or is in flow communication with concave cavity 52 to define a passage 56 configured to facilitate rapidly draining rainwater from tent fabric 14 to prevent or limit undesirable accumulation of rainwater on tent fabric 14. In one embodiment, passage 56 is defined by a rotary arc surface 58 having an axis defined outside tent 10.

In the exemplary embodiment, tent fabric 14 and/or apron fabric 18 is connected with or coupled to a gauze or netted fabric 60. Netted fabric 60 may include any suitable material that allows rainwater to flow through netted fabric 60. In one embodiment, netted fabric 60 includes a material suitable for allowing rainwater to flow through netted fabric 60 while preventing debris, such as leaves and twigs, from flowing through netted fabric 60. As shown in FIG. 2, a top edge 62 of netted fabric 60 is coupled to side support 26 by connecting fabric 42, and a bottom edge 64 is connected or coupled transversally with a central region of concave cavity 52 such that an upper portion of passage 56 defined by concavity 54 has a first angle ($\alpha$) with respect to connecting fabric 42, as shown in FIG. 2, and a lower portion of passage 56 defined by concave cavity 52 has a second angle ($\beta$) with respect to connecting fabric 42, as shown in FIG. 2. In one embodiment, first angle ($\alpha$) and second angle ($\beta$) are different with first angle ($\alpha$) a sharp angle and second angle ($\beta$) an obtuse angle such that the rainwater collected on tent fabric 14 may be drained rapidly to prevent accumulation. In the exemplary embodiment, second angle ($\beta$) is greater than first angle ($\alpha$). In a further embodiment, first angle ($\alpha$) is less than 90° and/or second angle ($\beta$) is an obtuse angle.

The present disclosure provides a portable structure, such as a tent or a gazebo, which defines an interior volume suitable for accommodating one or more occupants. The portable structure includes a draining component or structure configured to facilitate draining rainwater to prevent or limit undesirable accumulation of rainwater on the portable structure. The portable structure includes a frame having a central support and side supports positioned on opposing sides of the central support. Each side support is shorter than the central support. A roof fabric has a first edge coupled to the central support and an opposing second edge coupled to the side support. At least a portion of the roof fabric extends downward at the second edge with respect to a ground plane to define a concavity. An apron fabric is coupled at a top edge to the roof fabric at a joint. The apron fabric is configured to extend toward the ground plane. At least a portion of the apron fabric at the top edge defines a concave cavity that extends inward with respect to the interior volume of the portable structure. The concave cavity is in flow communication with the concavity to define a passage configured to drain rainwater from the roof fabric. In a particular embodiment, the passage is defined by a rotary arc surface having an axis outside the tent.

The top edge of the apron fabric is at least partially coupled to the second edge of the roof fabric at the joint to define the passage. In the exemplary embodiment, a connecting fabric couples the top edge of the apron fabric and/or the second edge of the roof fabric to the side support. A netted fabric has a first portion or edge coupled to the top portion of the apron fabric defining the concave cavity and an opposing second portion or edge coupled to the connecting fabric. The first portion or edge of the netted fabric is coupled transversally with a central region of the apron fabric defining the concave cavity and/or coupled transversally with a central region of the tent fabric defining the concavity such that an upper portion of the passage defined by the concavity has a first angle with respect to the connecting fabric and a lower portion of the passage defined by the concave cavity has a second angle with respect to the connecting fabric greater than the first angle. In a particular embodiment, the first angle is less than 90° and/or the second angle is an obtuse angle.

The embodiments described herein provide a portable structure, such as a tent, having a draining mechanism or structure that facilitates preventing water, such as rainwater, from accumulating on the roof or tent fabric, and therefore facilitates overcoming such noted drawbacks associated with some conventional tents.

In one embodiment, the tent includes a tent frame, a tent fabric connected with the tent frame, and an apron fabric connected to a lower circumferential or peripheral edge portion of the tent fabric. A top portion of the apron fabric defines a concave cavity that extends inward with respect to the apron fabric into an interior volume defined by the tent. A portion of the tent fabric is connected with the top portion of the apron fabric defining the concave cavity and extends downward towards a ground plane to define a concavity. This concavity cooperates with or is in flow communication with the concave cavity to define a passage for draining rainwater collected on the tent fabric to prevent or limit accumulation of rainwater on the tent fabric. In one embodiment, the apron fabric is located on an outside of the tent frame. The apron fabric is connected with a gauze or netted fabric having a bottom portion that is connected with or coupled to the top portion of the concave cavity. In a further embodiment, the passage for draining the rainwater is defined at least partially by a rotary arc surface having an axis defined outside of the tent.

The tent frame includes a central support and at least two side supports. The two side supports are located on opposite sides of the central support and have a height less than a height of the central support. A top or central portion of the tent fabric is connected with the central support, and a joint coupling the apron fabric and the tent fabric is connected with or coupled to the side support. A top of the netted fabric is also coupled to the side support.

In contrast with conventional tents, the embodiments described herein facilitate preventing or limiting an accumulation of rainwater on the tent fabric and facilitate preventing or limiting wetting of the tent frame by the rainwater. In the exemplary embodiment, the concave cavity of the apron fabric extends inward, the edge portion of the tent fabric is connected with or coupled to the top edge portion of the apron fabric defining the concave cavity and extends downward to define a concavity, and this concavity cooperates with and/or is in flow communication with the concave cavity to define a passage for the rainwater collected on the tent fabric to drain through. Therefore, the rainwater may drain off the tent fabric through the passage to prevent or limit accumulation of rainwater on the tent fabric. The bottom portion of the netted fabric is connected or coupled transversally with the apron fabric and/or the tent fabric that at least partially defines the passage for draining rainwater. The netted fabric does not prevent the drainage of rainwater, and the joint between the netted fabric and the passage may be pulled outward to be elevated to increase a rate of the rainwater drainage. In one embodiment, the passage for draining rainwater is defined by a rotary arc surface having an axis such that a relatively large amount of rainwater on the tent fabric may be drained off rapidly through the passage.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tent defining an interior volume and configured to facilitate draining rainwater, the tent comprising:

a frame;

a tent fabric connected with the frame, an edge portion of the tent fabric extending downward with respect to a ground plane to define a concavity that extends inward with respect to the interior volume of the tent;

an apron fabric connected with the tent fabric at a joint, an edge portion of the apron fabric defining a concave cavity that extends inward with respect to the interior volume of the tent, the edge portion of the tent fabric defining the concavity connected with the edge portion of the apron fabric defining the concave cavity, and the concavity in flow communication with the concave cavity to define a passage configured to drain rainwater from the tent fabric; and a netted fabric having a portion that is connected to the edge portion of the apron fabric defining the concave cavity.

2. A tent in accordance with claim 1, wherein the apron fabric is located outside the tent frame.

3. A tent in accordance with claim 1, wherein the passage is defined by a rotary arc surface having an axis outside the tent.

4. A tent in accordance with claim 1, wherein the tent frame comprises a central support and at least two side supports, the at least two side supports located at opposing sides of the central support and shorter than the central support, a top of the tent fabric connected with the central support, and the joint connecting the apron fabric and the tent fabric connected with one of the at least two side supports.

5. A tent in accordance with claim 4, wherein the top of the tent fabric hangs from the central support, and the joint hangs from the side support.

6. A portable structure defining an interior volume, and configured to facilitate draining rainwater, the portable structure comprising:

a frame comprising a central support and a side support shorter than the central support;

a roof fabric having a first edge coupled to the central support and an opposing second edge coupled to the side support, at least a portion of the roof fabric extending downward at the second edge with respect to a ground plane to define a concavity;

an apron fabric coupled to the roof fabric at a joint, the apron fabric configured to extend toward the ground plane, a portion of the apron fabric defining a concave cavity that extends inward with respect to the interior volume of the portable structure, the concave cavity in flow communication with the concavity to define a passage configured to drain rainwater from the roof fabric; and a connecting fabric coupled to the joint and the side support, the connecting fabric extending across the passage.

7. A portable structure in accordance with claim 6, wherein an edge of the apron fabric is at least partially coupled to the second edge of the roof fabric at the joint to define the passage.

8. A portable structure in accordance with claim 7, wherein the connecting fabric couples the edge of the apron fabric at least partially coupled to the second edge of the roof fabric to the side support.

9. A portable structure in accordance with claim 8, further comprising a netted fabric having a first portion coupled to the portion of the apron fabric defining the concave cavity and an opposing second portion coupled to the connecting fabric.

10. A portable structure in accordance with claim 9, wherein the first portion of the netted fabric is coupled transversally with a central region of the apron fabric defining the concave cavity such that an upper portion of the passage defined by the concavity has a first angle with respect to the connecting fabric and a lower portion of the passage defined by the concave cavity has a second angle with respect to the connecting fabric greater than the first angle.

11. A portable structure in accordance with claim 10, wherein the first angle is less than 90°.

12. A portable structure in accordance with claim 10, wherein the second angle is an obtuse angle.

13. A portable structure in accordance with claim 6, wherein the passage is defined by a rotary arc surface having an axis outside the tent.

14. A method for making a tent configured to facilitate draining rainwater, the method comprising:

forming a tent fabric having a first edge that is configured to couple to a first support and an opposing second edge configured to couple to a second support shorter than the first support such that, with the tent constructed to define an interior volume, at least a portion of the tent fabric extends downward at the second edge with respect to a ground plane to define a concavity;

coupling an apron fabric to the tent fabric at a joint, with the tent constructed, the apron fabric is configured to extend toward the ground plane, and a portion of the apron fabric defines a concave cavity that extends inward with respect to the interior volume of the constructed tent, the concave cavity in flow communication with the concavity to define a passage configured to drain rainwater from the tent fabric; and coupling a connecting fabric to at least one of an edge of the apron fabric and the second edge of the tent fabric and to the second support, the connecting fabric extending between the joint and the second support and extending across the passage.

15. A method in accordance with claim 14, further comprising at least partially coupling an edge of the apron fabric to the second edge of the tent fabric at the joint to at least partially define the passage.

16. A method in accordance with claim 14, further comprising coupling a netted fabric to the tent, the netted fabric having a first portion coupled to the portion of the apron fabric defining the concave cavity and an opposing second portion coupled to the connecting fabric.

17. A method in accordance with claim 16, wherein the first portion of the netted fabric is coupled transversally with a central region of the apron fabric defining the concave cavity such that an upper portion of the passage defined by the concavity has a first angle with respect to the connecting fabric and a lower portion of the passage defined by the concave cavity has a second angle with respect to the connecting fabric greater than the first angle.

* * * * *